US010881930B1

(12) United States Patent
Allen

(10) Patent No.: US 10,881,930 B1
(45) Date of Patent: Jan. 5, 2021

(54) GOLF BALL HOLDER

(71) Applicant: Kelly Allen, Jacksonville, FL (US)

(72) Inventor: Kelly Allen, Jacksonville, FL (US)

( * ) Notice: Subject to any disclaimer, the term of this patent is extended or adjusted under 35 U.S.C. 154(b) by 0 days.

(21) Appl. No.: 16/780,017

(22) Filed: Feb. 3, 2020

(51) Int. Cl.

| | |
|---|---|
| ***A63B 57/20*** | (2015.01) |
| ***A45F 5/02*** | (2006.01) |
| *A63B 45/02* | (2006.01) |
| *A63B 55/20* | (2015.01) |

(52) U.S. Cl.
CPC ..... *A63B 57/20* (2015.10); *A45F 5/021* (2013.01); *A63B 45/02* (2013.01); *A63B 55/20* (2015.10)

(58) Field of Classification Search
CPC ..... A45F 5/021; A63B 57/20; A63B 55/20; A63B 45/02
See application file for complete search history.

(56) References Cited

U.S. PATENT DOCUMENTS 1,911,256 A * 5/1933 Andrew ..... A63B 57/20 224/247
2,548,330 A * 4/1951 Wiseman ..... A63B 57/20 224/245
2,665,830 A * 1/1954 Fowler ..... A63B 47/001 224/247
2,768,775 A * 10/1956 Houser ..... A63B 47/001 221/185
3,873,009 A * 3/1975 Goudreau ..... A63B 47/001 224/247
4,062,482 A * 12/1977 Szalony ..... A63B 47/001 224/247
4,082,209 A * 4/1978 Sanders ..... A63B 47/002 211/15
4,269,338 A * 5/1981 Sichel ..... A63B 47/001 224/242
5,842,621 A * 12/1998 Gschwind ..... A41F 9/002 224/682
6,102,263 A * 8/2000 Rosato ..... A63B 47/001 224/196
6,168,061 B1 * 1/2001 Harrison ..... A63B 47/001 224/666
6,193,120 B1 * 2/2001 Chang ..... A63B 47/001 224/245
6,516,982 B1 * 2/2003 Childers ..... A45F 5/02 224/197
2002/0005124 A1 * 1/2002 Parks ..... A63B 69/3688 101/127
2007/0197309 A1 * 8/2007 Geraty ..... A63B 69/3655 473/257
2008/0271334 A1 * 11/2008 Sung ..... A63B 45/02 33/562

* cited by examiner

*Primary Examiner* — Anita M King
(74) *Attorney, Agent, or Firm* — Lawrence J. Gibney, Jr.

(57) ABSTRACT

The golfer sometimes wants or needs to have a golf ball ready for immediate play when the golfer's golf ball is lost. This device will allow the golfer to place a golf ball into a cavity of the device that is provided between an upper and low jaw.

A pair of jaws that are connected by a spring will allow the golf ball to remain in position during normal play but at the same time allow the golfer to easily retrieve the golf ball within the cavity. When the golfer needs to use another ball, the golfer simply grabs the golf ball on its side and separates the jaws to retrieve the golf ball. The golfer can place the device on his or her pants or golf bag so that the golf ball is readily available.

9 Claims, 6 Drawing Sheets

GOLF BALL HOLDER

FIELD OF THE INVENTION

This device allows a golfer to carry a golf ball securely around a person's belt or golf bag. In addition the user of this device also has the ability to mark the ball, which is important in terms of finding a golfer's ball.

PRIOR ART

There are several prior art references that discuss golf ball holders and a representative sample of this could be found at Childers, U.S. Pat. No. 6,516,982.

Other examples include Harrison, U.S. Pat. No. 6,168,061. This type of device is clipped to the belt and has two half-circles into which your golf balls can be placed. A area for tees is also provided.

Another reference that is found in the prior art is Sanders, U.S. Pat. No. 4,082,209. This is a vertical tube that will allow the user to store multiple golf balls. In the present application, only one golf ball can be carried with this device.

Other examples that can be found in the prior art include Wiseman, U.S. Pat. No. 2,548,330 and Andrew, U.S. Pat. No. 1,911,256. None of the other prior art references teach the features that are found in the current application.

BRIEF DESCRIPTION OF THE INVENTION

Oftentimes the golfer sometimes needs access to a single golf ball, which should be marked by the golfer so that the correct ball can be found during a round of golf. This is important if the golfer makes an errant shot and loses a ball. It is also important to be able to distinguish one golfer's ball from the other golfers, particularly if a foursome of golfers is involved.

This device can be clipped to the belt of the golfer or to his or her golf bag. The device will store one golf ball that will remain securely within the device during normal play.

The device will have two jaws: an upper jaw and a lower jaw. The upper jaw can be separated from the lower jaw using a pair of flat or slightly curved flat surfaces to separate the jaws; the flat surfaces may also be knurled. A spring is used so that the jaws will again go back to the normal shape when the user no longer presses the flat surfaces that separate the jaws.

A cavity is produced between the upper and lower jaw into which the golf ball will fit. A spring is provided that will separate the upper jaw from the lower jaw to get access to the golf ball. An opening may be provided on the top surface of the upper jaw to enable the golfer to mark his or her ball.

A clip is provided to secure the device to the golfer's pants or golf bag. The clip will rotate away from the golf ball holder so that the user can easily attach the device to the pants of golf bag. A separate spring clip will also allow the clip to rotate so that the individual golfer can put the device on the golfer's belt.

Additionally, in order to provide additional grip surface to the golfer's pants or bag, a textured bottom on the bottom surface of the clip will be provided.

NUMBERING REFERENCES

Figure 1:
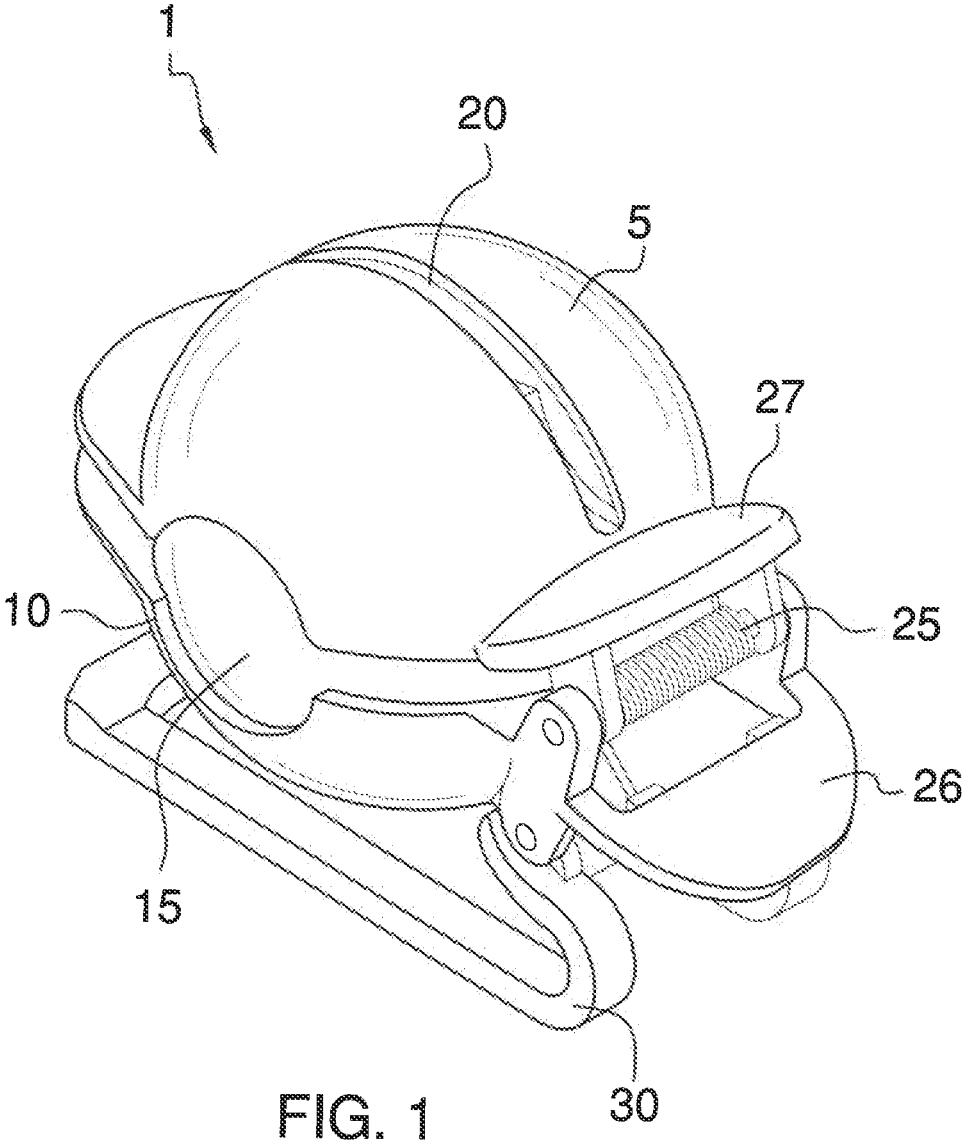
FIG. 1 is an isometric view of the device.
Figure 2:
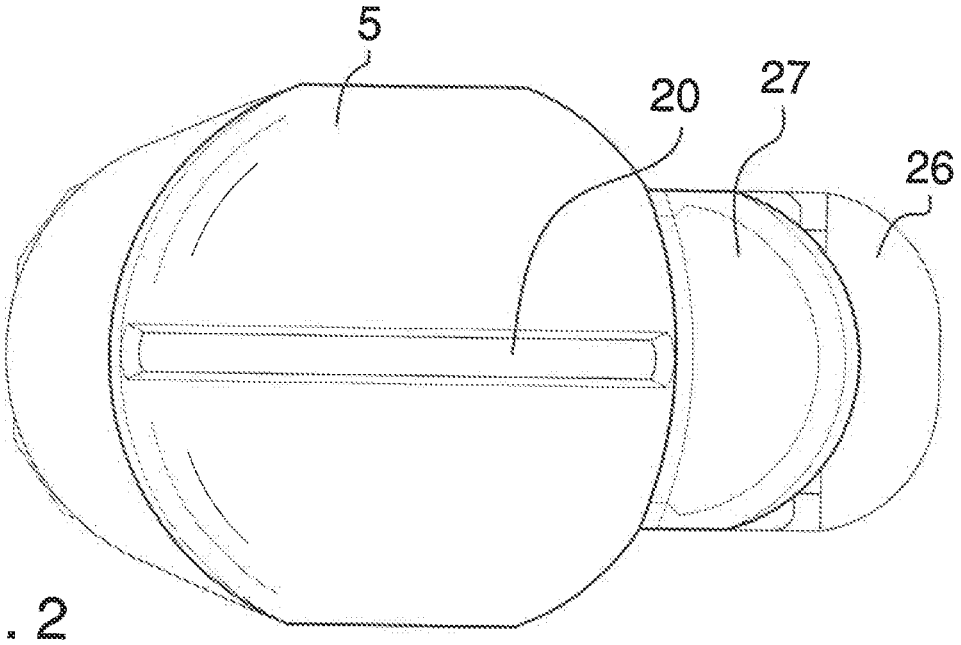
FIG. 2 is a top view of the device and depicts the opening as a line.
Figure 3:
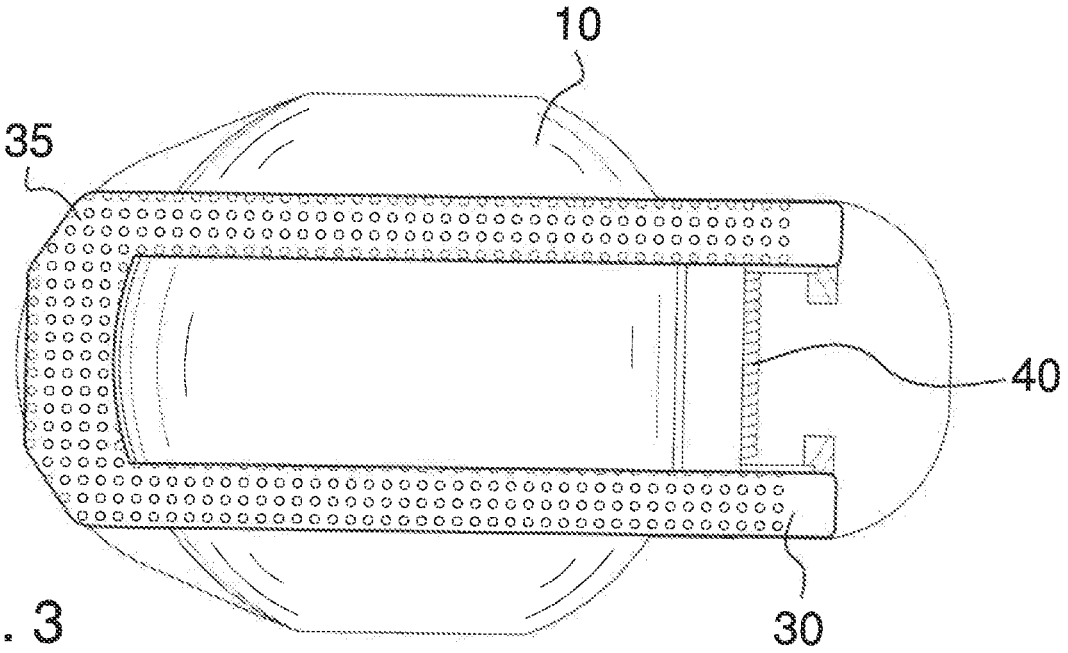
FIG. 3 is a bottom view of the device.
Figure 2A:
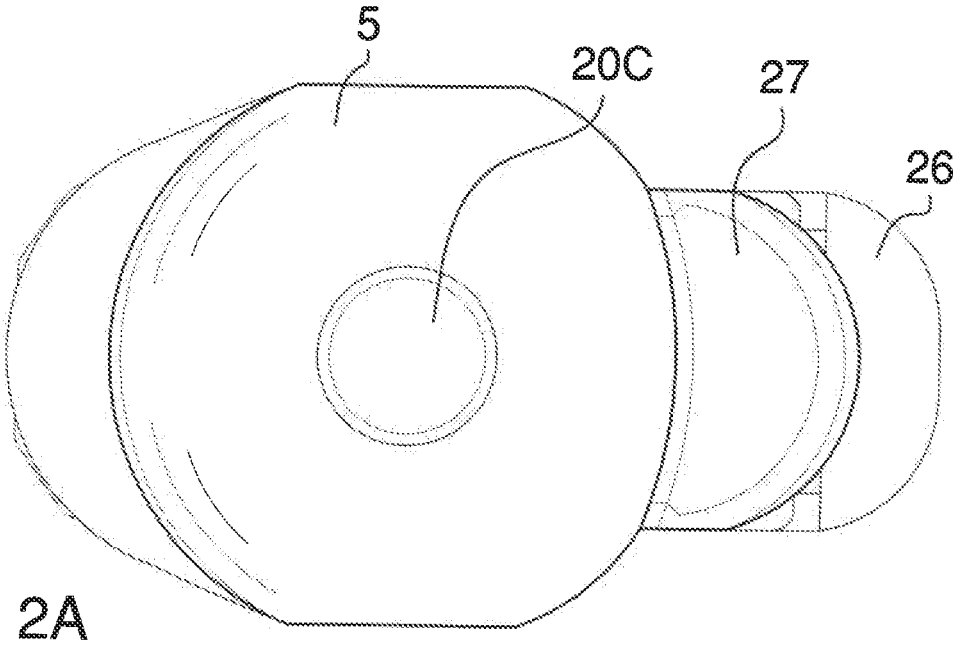
FIG. 2A is a top view of the device and depicts the opening as a circle.
Figure 2B:
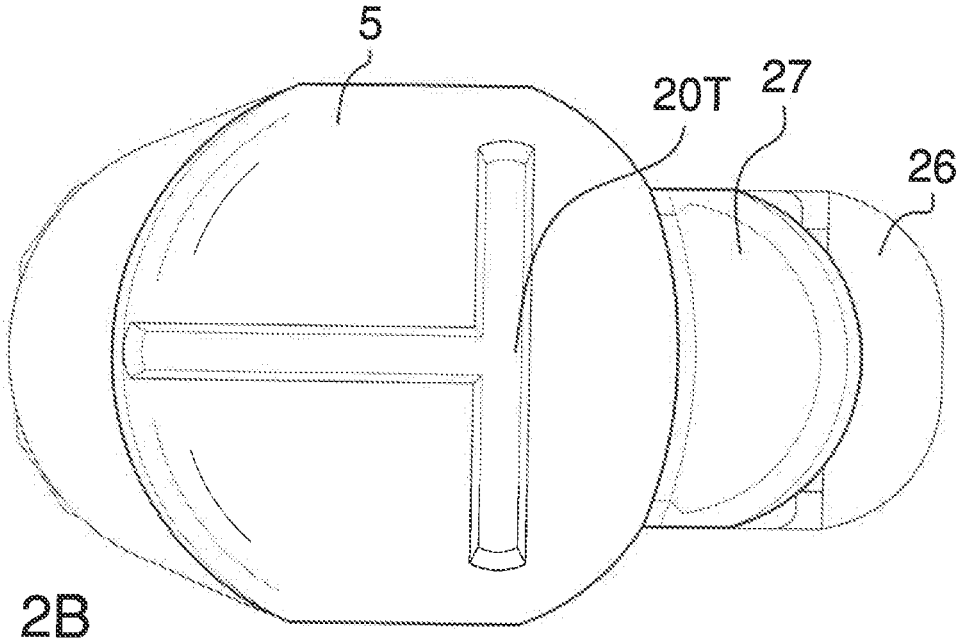
FIG. 2B is a top view of the device and depicts the opening as a T.
Figure 4:
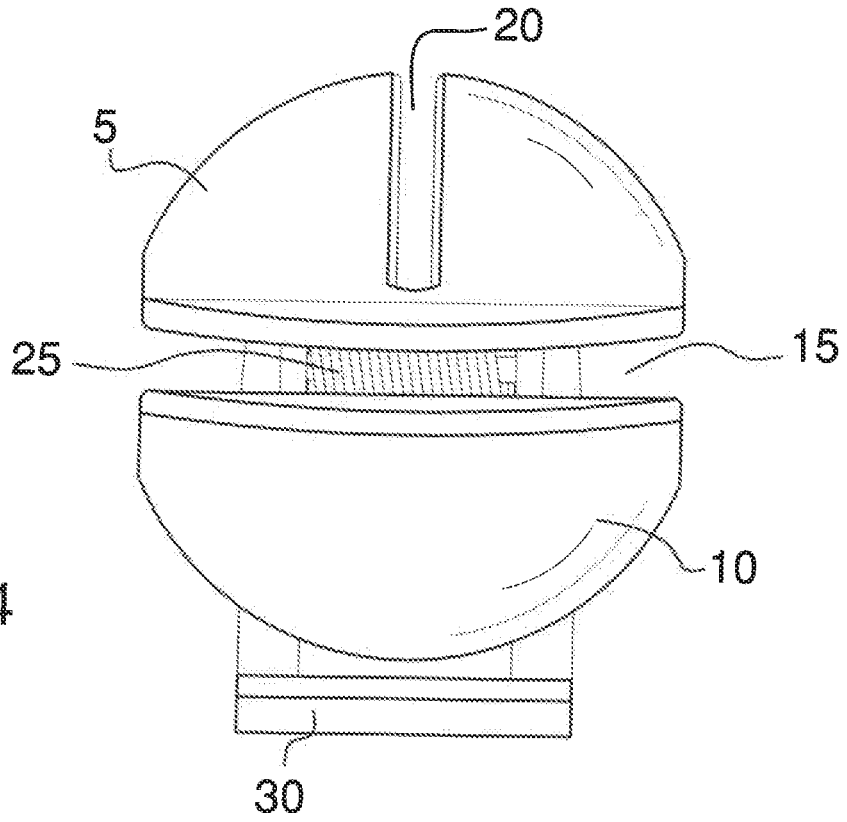
FIG. 4 is a front view of the golf ball holder.
Figure 5:
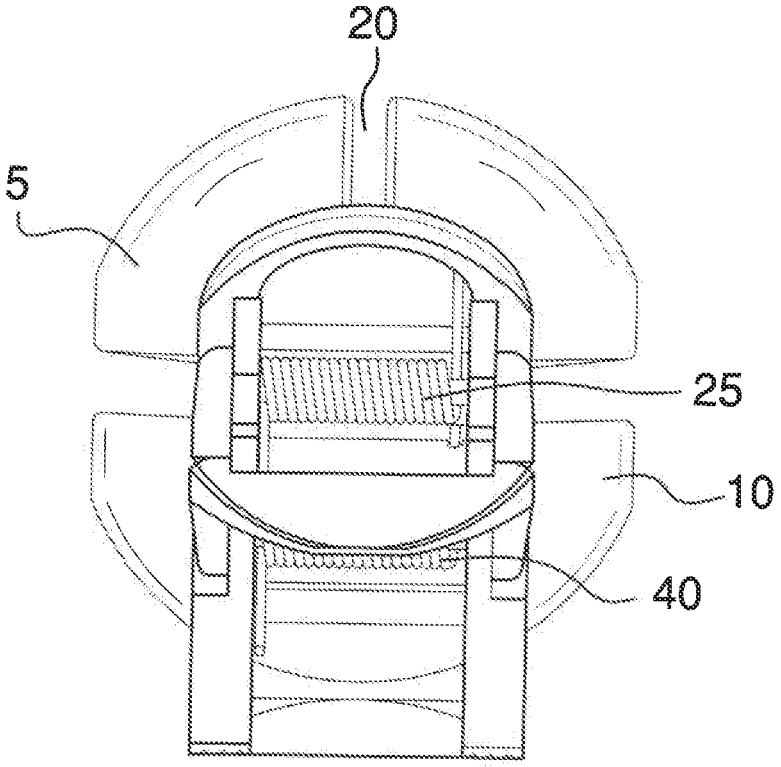
FIG. 5 is a back view of the front of the golf ball holder.
Figure 6:
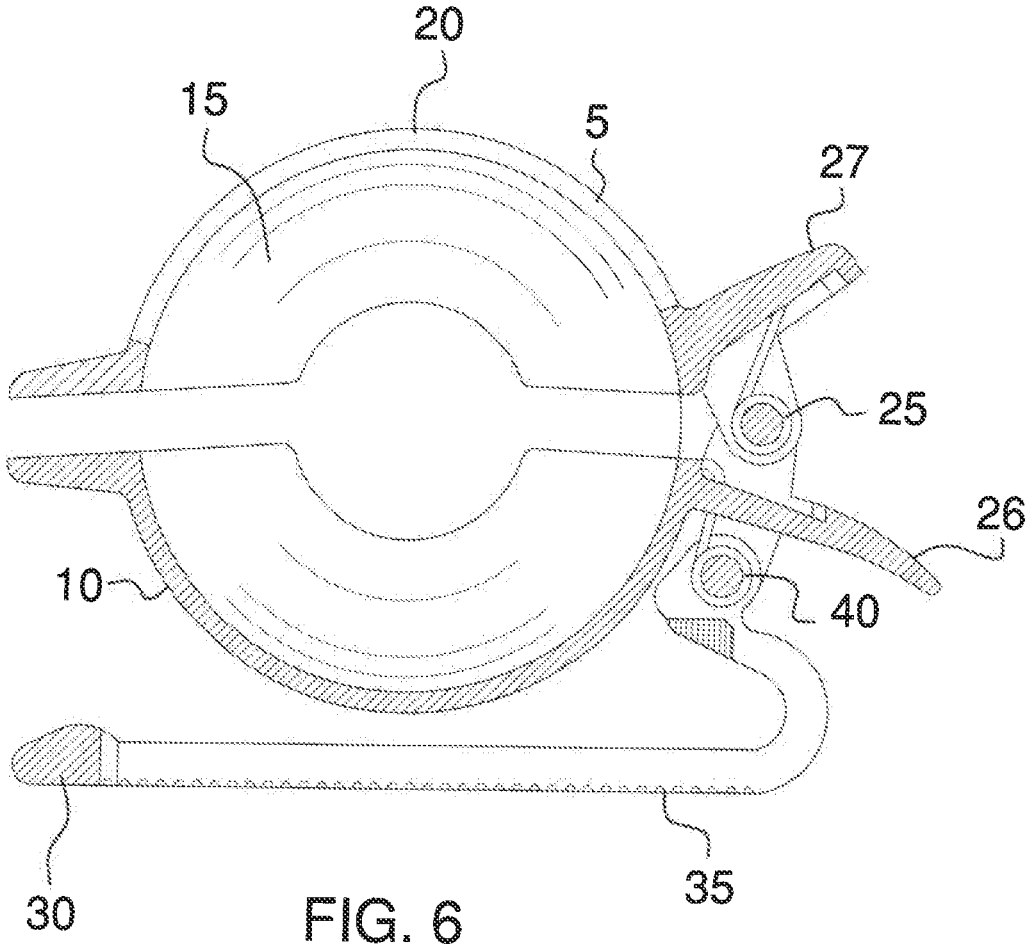
FIG. 6 is a cross sectional view of the golf ball holder.
Figure 7:
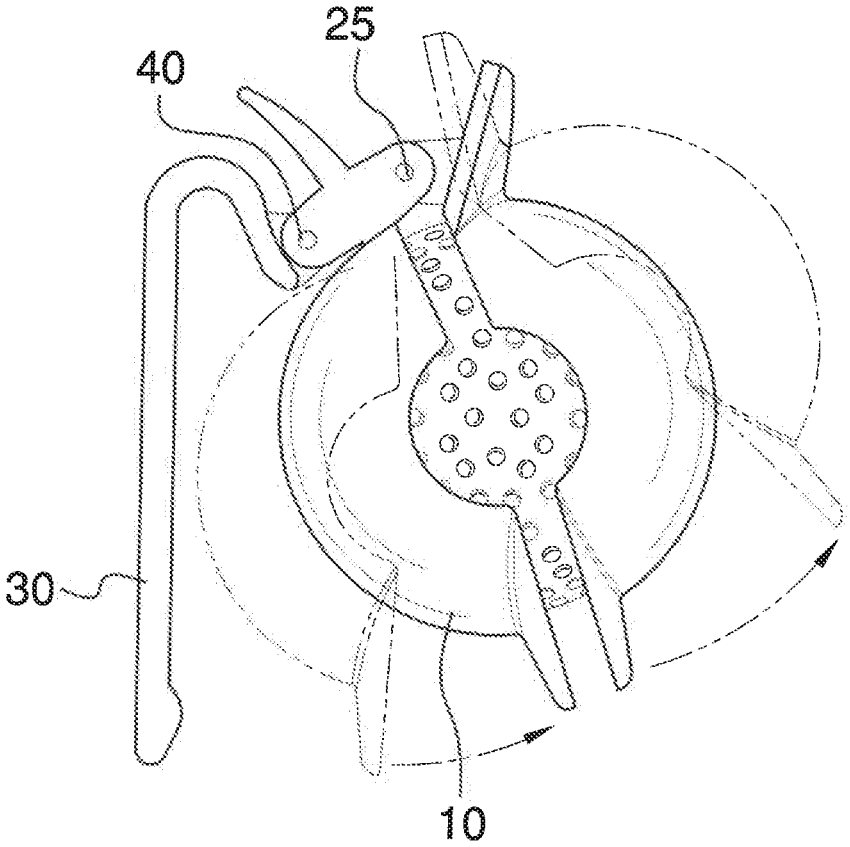
FIG. 7 is an in-use view of the golf ball holder.

1 Device
5 Upper Jaw
10 Lower Jaw
15 Inner cavity for golf ball
20 Opening on the upper jaw
20C Circular opening on the upper jaw
20T T shaped opening on the upper jaw
25 Holder Spring
26 Flat surface on lower jaw
27 Flat surface on upper jaw
30 Clip
35 Textured bottom
40 Clip spring

DETAILED DESCRIPTION OF THE EMBODIMENTS

This device 1 will attach to the belt of the golfer during normal play and will permit a golf ball to be placed in an inner cavity 15, between the upper jaw 5 and the lower jaw 10. Both the upper jaw 5 and the lower jaw 10 have an opening on both sides of the respective jaws to allow the golfer to grab the golf ball in the holder when needed and easily retrieve the golf ball if needed. The lower jaw 10 is an integral part of the clip 30.

A holder spring 25 will be provided that will separate the allow the user to separate the upper and lower jaws to release the ball to the golfer or for the golfer to place a ball in the cavity. An opening 20 of the surface of the top jaw will allow the golfer to mark his or her ball. The opening is depicted as a straight line 20 but can be in the shape of a T 20T or circle 20C or cross to name just a few examples. The top jaw may also be solid so that the marking line is not present.

A clip spring 40 will allow the device to rotate so the device be attached to the belt of the golfer or the golf bag. The clip spring 40 operates independently of the holder spring 25 that separates the upper jaw 5 from the lower jaw 10 to expose the cavity 15 for the golf ball. A flat surface 27 on the upper jaw and a flat surface 26 on the lower jaw are provided so that the user can easily separate the top jaw from the lower jaw. The flat surface 27 on the upper jaw and the flat surface on the lower jaw 26 may be slightly curved or knurled to make it easier to use the device to separate the two jaws.

The textured bottom on the bottom of the clip 30 will be provided to ensure additional gripping surface so that the golf ball holder does not slip off the pants of the golfer during normal play. While the application describes the clip attaching to the pants of the golfer, the clip 30 may also be attached to the golf bag of the golfer.

The golf ball holder 1 is designed to be portable and lightweight and the material that is used should be weather resistant.

The inventor claims:

1. A golf ball holder which is comprised of a clip, wherein the clip has a top surface and a bottom surface, wherein the bottom surface of the clip is raised, a pair of jaws, wherein the pair of jaws is further comprised of an upper jaw and a lower jaw, wherein a holder spring attaches the upper jaw to the lower jaw, a flat piece on the upper jaw, a flat piece on the lower jaw, wherein the lower jaw is formed as an integral part of the clip, wherein the pair of jaws are connected to each other by the holder spring, wherein the holder spring secures the pair of jaws at one end, wherein a golf ball will fit within a ball opening, wherein an opening is provided on the upper jaw, wherein the opening is a predetermined size, a spring clip.

2. The golf ball holder as described in claim 1 wherein the opening on the upper jaw is a straight line.

3. The golf ball holder as described in claim 1 wherein the opening on the upper jaw is in the shape of a T.

4. The golf ball holder as described in claim 1 wherein the opening on the upper jaw is in the shape of a circle.

5. The golf ball holder as described in claim 1 wherein the flat piece on the upper jaw is slightly curved.

6. The golf ball holder as described in claim 1 wherein the flat piece on the lower jaw is slightly curved.

7. The golf ball holder as described in claim 1 wherein the flat piece on the upper jaw is knurled.

8. The golf ball holder as described in claim 1 wherein the flat piece on the lower jaw is knurled.

9. The golf ball holder as described in claim 1 wherein the surface of the upper jaw is solid.

* * * * *